US005322615A

United States Patent [19]

Holtermann et al.

[11] Patent Number: 5,322,615

[45] Date of Patent: Jun. 21, 1994

[54] METHOD FOR REMOVING SULFUR TO ULTRA LOW LEVELS FOR PROTECTION OF REFORMING CATALYSTS

[75] Inventors: Dennis L. Holtermann, Crockett; Warren E. Brown, Hercules, both of Calif.

[73] Assignee: Chevron Research and Technology Company, San Francisco, Calif.

[21] Appl. No.: 804,600

[22] Filed: Dec. 10, 1991

[51] Int. Cl.[5] ..... C10G 45/00; C10G 25/00

[52] U.S. Cl. ..... 208/91; 208/227

[58] Field of Search ..... 208/91, 217, 227

[56] References Cited

U.S. PATENT DOCUMENTS

| | | | |
|---|---|---|---|
| 4,163,708 | 8/1879 | Jacobson et al. | 208/89 |
| 4,179,361 | 12/1979 | Michlmayr | 208/244 |
| 4,204,947 | 5/1980 | Jacobson et al. | 208/243 |
| 4,225,417 | 9/1980 | Nelson | 208/91 |
| 4,446,005 | 5/1984 | Eberly, Jr et al. | 208/91 |
| 4,456,527 | 6/1984 | Buss et al. | 208/89 |
| 4,634,515 | 1/1987 | Bailey et al. | 208/91 |
| 4,925,549 | 5/1990 | Robinson et al. | 208/65 |
| 5,106,484 | 4/1992 | Nadler et al. | 208/91 |

*Primary Examiner*—Helane Myers

*Attorney, Agent, or Firm*—Burns, Doane, Swecker & Mathis

[57] ABSTRACT

Provided is a method for removing residual sulfur from a hydrotreated naphtha feedstock. The process comprises contacting the naphtha feedstock with a first solid sulfur sorbent comprising a metal on a support to thereby form a first effluent. The effluent is then contacted with a sulfur conversion catalyst comprising a Group VIII metal in the presence of hydrogen, with the resulting effluent being contacted with a second solid sulfur sorbent containing a Group IA or IIA metal, to thereby lower the sulfur content of the feedstock to less than 10 ppb, and to as low as 1 ppb or less. The feedstock can then be safely used with highly sulfur sensitive zeolitic reforming catalysts without adversely affecting the useful life of the catalyst.

46 Claims, 1 Drawing Sheet

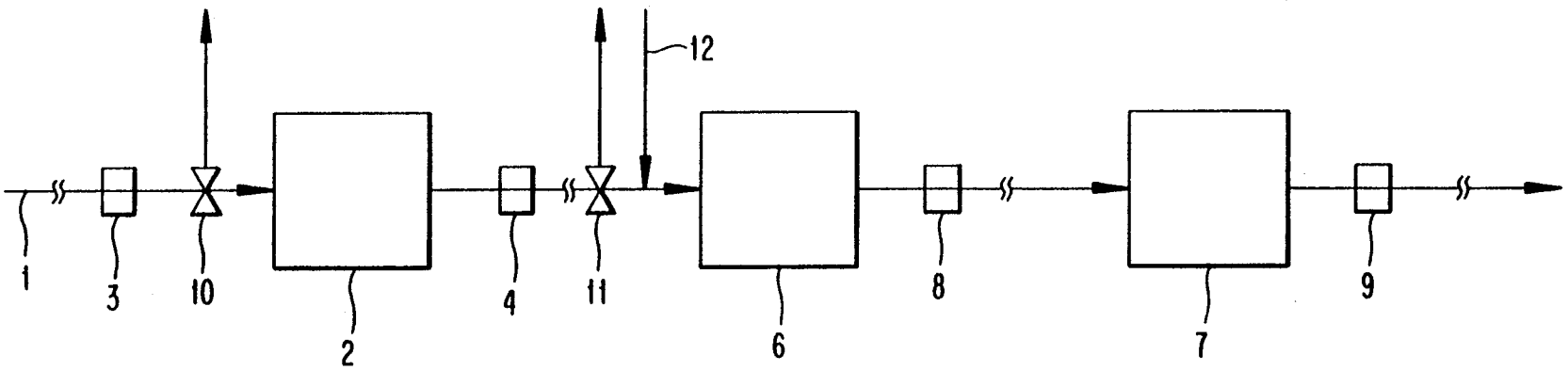
1
3
10
2
4
11
12
6
8
7
9

METHOD FOR REMOVING SULFUR TO ULTRA LOW LEVELS FOR PROTECTION OF REFORMING CATALYSTS

BACKGROUND OF THE INVENTION

The present invention relates to the removal of sulfur from a hydrocarbon feedstock. In another embodiment, the present invention relates to a reforming process using a highly sulfur sensitive catalyst which can be efficiently and effectively run for up to two years.

Generally, sulfur occurs in petroleum and syncrude stocks as hydrogen sulfide, organic sulfides, organic disulfides, mercaptans, also known as thiols, and aromatic ring compounds such as thiophene, benzothiophene and related compounds. The sulfur in aromatic sulfur-containing ring compounds will be herein referred to as "thiophene sulfur".

Conventionally, feeds with substantial amounts of sulfur, for example, those with more than 10 ppm sulfur, are hydrotreated with conventional hydrotreating catalysts under conventional conditions, thereby changing the form of most of the sulfur in the feed to hydrogen sulfide. Then, the hydrogen sulfide is removed by distillation, stripping or related techniques. Unfortunately, these techniques often leave some traces of sulfur in the feed, including thiophene sulfur, which is the most difficult type to convert.

Such hydrotreated naphtha feeds are frequently used as feeds for catalytic dehydrocyclization, also known as reforming. Catalytic reforming processes play an integral role in upgrading naphtha feedstocks to high octane gasoline blend stocks and for chemicals such as benzene, toluene and xylenes. These processes have become more important in recent years because of the increase in demand for low-lead and unleaded gasolines. However, some of the catalysts used in reforming are extremely sulfur sensitive, particularly those that contain zeolitic components. It is generally recognized, therefore, that the sulfur content of the feedstock must be minimized to prevent poisoning of such reforming catalysts.

One conventional method for removing residual hydrogen sulfide and mercaptan sulfur is the use of sulfur sorbents. See, for example, U.S. Pat. Nos. 4,204,947 and 4,163,708, the contents of which are hereby incorporated by reference. The concentration of sulfur in this form can be reduced to considerably less than 1 ppm by using the appropriate sorbents and conditions, but it has been found to be difficult to remove sulfur to less than 0.1 ppm, or to remove residual thiophene sulfur. See, for example, U.S. Pat. No. 4,179,361 the contents of which is hereby incorporated by reference, and particularly Example 1 of that patent. Very low space velocities are required to remove thiophene sulfur, requiring large reaction vessels filled with sorbent. Even with these precautions, traces of thiophene sulfur still can be found.

See also U.S. Pat. No. 4,456,527, the contents of which is hereby incorporated by reference, disclosing a hydrocarbon conversion process having a very high selectivity for dehydeocyclization. In one aspect of the disclosed process, a hydrocarbon feed is subjected to hydrotreating, and then the hydrocarbon feed is passed through a sulfur removal system which reduces the sulfur concentration of the hydrocarbon feed to below 500 ppb (0.5 ppm). The resulting hydrocarbon feed is then reformed.

Various possible sulfur removal systems are disclosed for reducing the sulfur concentration of the hydrocarbon feed to below 500 ppb. The various systems mentioned include

- passing the hydrocarbon feed over a suitable metal or metal oxide, for example copper, on a suitable support, such as alumina or clay, at low temperatures in the range of 200° F. to 400° F. in the absence of hydrogen; or,
- passing a hydrocarbon feed, in the presence or absence of hydrogen, over a suitable metal or metal oxide, or combination thereof, on a suitable support at medium temperatures in the range of 400° F. to 800° F.; or,
- passing a hydrocarbon feed over a first reforming catalyst, followed by passing the effluent over a suitable metal or metal oxide on a suitable support at high temperatures in the range of 800° F. to 1000° F.; or
- passing a hydrocarbon feed over a suitable metal or metal oxide and a Group VIII metal on a suitable support at high temperatures in the range of 800° F. to 1000° F.

Attempts continue, however, to reduce the amount of sulfur contained in the hydrocarbon feeds so as to a permit a longer useful life for zeolitic catalysts. Once a sulfur sensitive zeolitic catalyst is poisoned, it is very difficult if not impossible to regenerate the catalyst. Therefore, due to the presence of expensive metals such as platinum in such catalysts, the longer the useful life of the catalyst the more practical the process employing such a zeolitic catalyst becomes.

Accordingly, in U.S. Pat. No. 4,925,549 there is disclosed a process for removing sulfur to less than 0.1 ppm (100 ppb) in an attempt to protect reforming catalysts which are sulfur sensitive. This patent, the contents of which is hereby incorporated by reference, discloses a method which comprises first contacting a feedstock with hydrogen under mild reforming conditions in the presence of a less sulfur sensitive reforming (or sulfur conversion) catalyst. This carries out some reforming reactions and also converts trace sulfur compounds to hydrogen sulfide. The effluent from the first step is then contacted with a solid sulfur sorbent to remove the $H_2S$ and provide an effluent which contains less than 0.1 ppm sulfur. This low sulfur containing effluent can then be contacted with the highly selective reforming catalyst which is extremely sulfur sensitive.

While the state of the art has therefore progressed to protecting reforming catalysts which are sulfur sensitive to a large extent, greater protection is still desirable. Better catalyst stability than found in prior art processes using zeolitic catalysts is still an important objective of the art. The greater the stability of the catalyst, the longer the run length, which results in less down time and expense in regenerating or replacing the catalyst charge. The longer the run lengths, the more commercially practical the process. Without sulfur poisoning, it is believed that the practical useful life of a zeolitic catalyst is up to about two years. Therefore, a system which would permit a run length of up to about two years while using the highly preferred, but highly sulfur sensitive zeolitic catalysts would certainly be of a great practical advantage to the petroleum reforming industry.

Accordingly, it is an object of the present invention to provide a process which can remove substantially all sulfur, including thiophene sulfur, from a reforming feedstream.

Another object of the present invention is to provide a process which can efficiently reduce the amount of sulfur in a hydrocarbon feedstream to about 1 ppb or less.

Another object of the present invention is to integrate a sulfur removal system into a reforming process which would permit a practical useful life for the catalyst, e.g., of up to about two years.

These and other objects of the present invention will become apparent upon a review of the following specification, the drawing and the claims appended hereto.

SUMMARY OF THE INVENTION

In accordance with the foregoing objectives, this invention provides a most effective method for removing residual sulfur from a hydrotreated naphtha feedstock. The process comprises contacting the naphtha feedstock with a first solid sulfur sorbent comprising a metal on a support to thereby form a first effluent. The first effluent is then contacted with a sulfur conversion catalyst comprising a Group VIII metal in the presence of hydrogen, thereby forming a second effluent. The second effluent is then contacted with a second solid sulfur sorbent containing a Group IA or IIA metal, to thereby lower the sulfur content of the feedstock to less than 10 ppb, and to as low as 1 ppb or less.

In another embodiment, the present invention provides one with a method for efficiently reforming a naphtha feedstock while employing a sulfur sensitive zeolitic catalyst. The process comprises hydrotreating a naphtha feed and contacting the hydrotreated naphtha feed with a first solid sulfur sorbent comprising a metal on a support, thereby forming a first effluent. The first effluent is then contacted with a sulfur conversion catalyst comprising a Group VIII metal in the presence of hydrogen, whereby a second effluent is formed, and then the second effluent is contacted with a second solid sulfur sorbent comprising a Group IA or IIA metal, to thereby lower the sulfur content of the feed to less than 10 ppb sulfur. The resulting feed is then forwarded to at least one reforming reactor comprising a large-pore zeolitic catalyst containing at least one Group VIII metal, preferably platinum.

Among other factors, the present invention provides one with a method for effectively and efficiently reforming a naphtha feedstock containing sulfur while employing a highly sulfur sensitive reforming catalyst, such as a platinum containing L zeolite. The process safeguards the catalyst to the extent that a run length of up to about two years, i.e., the practical useful life of the zeolite catalyst, can be possible while maintaining good performance. This is achieved because the present invention permits one to reduce the amount of sulfur in the feedstream provided to the sulfur sensitive reforming catalyst to levels which have heretofore not been reached, i.e., levels of less than 10 ppb, and as low as 1 ppb, in an effective and efficient manner.

BRIEF DESCRIPTION OF THE DRAWING

The FIGURE of the Drawing schematically depicts a system for practicing a process of the present invention.

DETAILED DESCRIPTION OF THE PREFERRED EMBODIMENTS

A naphtha feedstock containing low molecular weight sulfur-containing impurities such as mercaptans, thiophene, and the like, is usually subjected to a preliminary hydrodesulfurization treatment. The effluent from this treatment is subjected to distillation-like processes to remove $H_2S$. The effluent from the distillation step will typically contain between 0.2 and 5 ppm sulfur, and between 0.1 and 2 ppm thiophene sulfur. These amounts of sulfur can poison selective sulfur sensitive reforming catalysts in a short period of time. Therefore, the process of the present invention for removing the sulfur is applied to the resulting hydrotreated naphtha stream to reduce the amount of sulfur to such low levels that extremely long run lifes of up to two years are achievable. The process can also be monitored and controlled to insure that the sulfur reduction is achieved so that downstream debilitating poisoning of the reforming catalyst used in the main reforming operation does not occur.

Referring to the Figure of the Drawing, the hydrotreated naphtha stream 1 is passed to a first sulfur sorber 2 in order to be contacted with a first solid sulfur sorbent. The sulfur sorbent comprises a sulfur scavenging metal on a support effective for the removal of sulfur from the feedstream. The metal is generally a metallic scavenger for sulfur such as copper or nickel. Commercially available sulfur sorbents can be used. For example, commercial sulfur sorbents made by the impregnation of alumina with copper solutions are readily available.

The most preferred sulfur sorbent for this first contacting step of the process, however, preferably contains nickel as the sulfur scavenger metal. The nickel is generally supported on an inorganic oxide support. An example of a commercially available nickel sulfur sorbent, which is the most preferred sulfur sorbent for the practice of the present invention, is a sorbent made by United Catalysts, Inc. called C28. The specifics relating to this sorbent are as follows:

| | Wt % |
|---|---|
| Chemical Composition | |
| Ni | 54.0 ± 4.0 |
| $SiO_2$ | 28.0 ± 3.0 |
| $Al_2O_3$ | 10.0 ± 1.0 |
| % Reduction, Minimum | 40 |
| Physical Properties | |
| Bulk Density, Lb/Cu Ft | 44.0 ± 2 |
| Surface Area, $M^2$/gm | 250–280 |
| Pore Volume, cc/gm | 0.50–0.55 |
| Crush Strength, Lb/mm (minimum Average) | 2.1 |
| Attrition, Wt % (ASTM) | <1 |

As can be seen from the above, the catalyst contains about 55 weight percent nickel. This solid sulfur sorbent is preferred because it has been found to give more complete mercaptan removal, even at fairly low space velocities, than conventional sulfur sorbents containing copper as the metal scavenger. Furthermore, due to the high nickel content of the sorbent, the sorbent has a greater theoretical sulfur capacity than more conventional copper sulfur sorbents.

The size of the sulfur sorber 2 can be designed to fit the particular needs of the process to be run. For example, the size can be designed to achieve a greater than 90% reduction in hydrotreated feed sulfur over a two year period. The size can also be specifically designed to provide a safeguard in case severe upstream hydrotreater upsets occur and/or sulfur levels reach 10 ppm in the feedstream. A sulfur analyzer can be employed at 3 prior to the sulfur sorber so as to detect any unusual amounts of sulfur in the feedstream. Another sulfur analyzer can be employed at 4 after the sulfur sorber 2 in order to detect the effectiveness of the sulfur sorber in removing sulfur. If a system upset does cause a problem such that inordinate amounts of sulfur are maintained in the feedstream, as detected by the sulfur analyzers 3 and 4, then the feedstream can be redirected or recirculated via valve 10 (and/or 11, if necessary) until the problem is resolved. The redirection/recirculation of the feedstream would only be necessary when the amount of sulfur is such that subsequent removal would not be feasible and catalyst poisoning would be imminent.

Generally, the amount of sulfur removed upon contacting the solid sulfur sorbent in sorber 2 reduces the amount of sulfur to 50 ppb or less. Success has been achieved with the initial reduction to 20 ppb and less.

The conditions employed in the first sulfur sorber are generally of an overall space velocity of about 0.2 to about 20 LHSV, with the overall space velocity preferably being from 1 to 5 LHSV. The pressure and temperature are very mild, the temperature can range from about 100° to 200° C., and more preferably from about 115° to 175° C., with the pressure being less than about 200 psig, and preferably in the range of 100 to 200 psig.

The analyzers 3 and 4 can be any conventional sulfur analyzer which is sufficiently sensitive. One conventional sulfur analyzer is the TRACOR ATLAS sulfur analyzer, which instrument has a 20 ppb value as its lowest detection limit of sulfur.

The effluent from the first solid sulfur sorber 2, hereinafter referred to as the first effluent, is then passed into a reactor 6 containing a sulfur conversion catalyst comprised of a Group VIII metal. The effluent is contacted with the reforming catalyst in the presence of hydrogen, which hydrogen can be introduced, e.g., into the first effluent, at 12. The reaction in the reactor 6 converts organic sulfur, including thiophenes, to hydrogen sulfide.

The conversion catalyst used to contact the first effluent comprises a Group VIII metal and, if desired, a promoter metal, supported on a refractory inorganic oxide metal. Suitable refractory inorganic oxide supports include alumina, silica, titania, magnesia, boria, and the like and combinations such as silica and alumina or naturally occurring oxide mixtures such as clays. The preferred Group VIII metal is platinum. Also, a promoter metal such as rhenium, tin, germanium, iridium, rhodium, or ruthenium, may be present. Preferably, the sulfur conversion catalyst of reactor 6 comprises platinum on an aluminum support. The catalyst can also include a promoter metal such as rhenium if desired, and the accompanying chloride. Such a reforming catalyst is discussed fully, e.g., in U.S. Pat. No. 3,415,737, the contents of which is hereby incorporated by reference.

The contacting in reactor 6 is carried out in the presence of hydrogen at a pressure adjusted to thermodynamically favor dehydrogenation and limit undesireable hydrocracking by kinetic means. The pressures which may be used vary from 15 psig to 500 psig, and are preferably between about 50 psig to about 300 psig; the molar ratio of hydrogen to hydrocarbons preferably being from 1:1 to 10:1, more preferably from 2:1 to 6:1.

The sulfur conversion reaction occurs with acceptable speed and selectivity at a temperature ranging from about 250° C. to 450° C. Therefore, reactor 6 containing the conversion catalyst is preferably operated at a temperature ranging from between about 250° C. and 425° C.

When the operating temperature of the reactor containing the conversion catalyst is more than about 300° C., the sulfur conversion reaction speed is sufficient to accomplish the desired reactions. At higher temperatures, such as 400° C. or more, reforming reactions, particularly dehydrogenation of napthenes, begin to accompany the sulfur conversion. Such reforming reactions are endothermic and may result in a temperature drop of 10° to 50° C. as the stream passes through this reactor. When the operating temperature of this reactor is much higher than 400° C., an unnecessarily large amount of reforming takes place which is accompanied by hydrocracking and coking. In order to minimize the undesirable side reactions, the reactor temperature should be not more than about 450° C., or preferably 425° C. The liquid hourly space velocity of the hydrocarbons in this contacting step with the sulfur conversion catalyst is preferably between 1 and 20, and is preferably from about 2 to 10.

Catalysts have varying sensitivities to sulfur in a feedstream. Some catalysts are less sensitive and do not show a substantially reduced activity if the sulfur level is kept below about 1 ppm. When the catalysts are deactivated by sulfur and coke buildup they can normally be regenerated by burning off the sulfur and coke deposits. Preferably, the sulfur conversion catalyst used for contacting the first effluent in reactor 6 is of this type.

The effluent from the conversion step (hereinafter the "second effluent"), is then contacted with a second solid sulfur sorbent containing a Group IA and IIA metal in sulfur sorber 7. The sorber is operated at moderate conditions comparable to those used in reactor 6. Generally, contact with this sulfur sorber reduces the amount of sulfur in the feedstream to less than 10 ppb, and more preferably less than 5 ppb to as low as 1 ppb or even less.

Preferred supports for the second solid sulfur sorbent include alumina, silica, titania, zirconia, boria, and the like, and mixtures thereof. Clays can also be used as supports. Particular clays of interest include the fibrous magnesium silicate clays, for example, attapulgite, palygorskite and sepiolite. The support can be premade by any method known in the art.

The surface area of the finished sulfur sorbent is in large part due to the support chosen. It is believed that the active sulfur sorbents of this invention can have nitrogen surface areas in the range of between 20 and 300 $m^2/g$.

The metal components of this second sulfur sorbent are Group IA or Group IIA metal containing compounds. The preferred metal components are sodium, potassium, calcium, and barium. The metal components are not in general present as the reduced metal. Instead, they are usually present in the form of a salt, oxide, hydroxide, nitrate, or other compound. It is the metal in the compound, in any form, that is the metal component of the sorbent of this invention. The sulfur sorbents of this invention can be made by impregnation of a preformed refractory inorganic oxide support with a metal component, or by comulling the metal component with an inorganic oxide support. It is preferred that the sulfur sorbent contain from 5 to about 40, and most preferably from 7 to about 15 wt % of the metal.

Preferred metal compounds include sodium chloride, sodium nitrate, sodium hydroxide, sodium carbonate, sodium oxalate, potassium chloride, potassium nitrate, potassium carbonate, potassium oxalate, potassium hydroxide, barium chloride, barium nitrate, barium carbonate, barium oxalate, barium hydroxide, calcium chloride, calcium nitrate, calcium carbonate, calcium oxalate, calcium hydroxide, and the like.

A preformed inorganic support can be impregnated with Group IA or Group IIA metals by standard techniques. It may be necessary to impregnate the support several times to achieve the desired amount of metal component on the inorganic support. Various metal compounds can be dissolved to form aqueous solutions useful for this impregnation. The preferred compounds for impregnation are the more soluble compounds. To be useful for impregnation, a compound should have a solubility of at least 0.1 mole per liter of water.

Another method of making the sulfur sorbents of this invention is by mulling the powdered inorganic support material, which can be prepeptized or mixed in the presence of a peptizing agent, together with a compound containing a Group IA or Group IIA metal. Preferred peptizing agents ar mineral acids, such as nitric acid. For example, peptized alumina powder could be mixed with a metal component, such as potassium carbonate. The resulting mass is then shaped, extruded, dried and calcined to form the final sulfur sorbent.

The choice of the appropriate compound to use during fabrication of the sulfur sorbent is primarily dictated by the solubility of the salt. For example, impregnation, very soluble salts are desired, such as nitrates, but in mulling, relatively insoluble salts, such as carbonates are preferred.

In a preferred embodiment of the present invention, the process generally involves the use of a potassium containing sulfur sorbent which is prepared using potassium not containing nitrate or other nitrogen containing compounds. Preferably, it involves the use of a sulfur sorbent made by impregnating alumina extrudate with potassium carbonate. When this aspect of the invention is employed particularly beneficial results can be obtained. That is the unwanted generation of water and ammonia, which can be harmful, particularly to certain catalysts such as zeolite-type catalysts, can be avoided.

Such a potassium containing sulfur sorbent removes the $H_2S$ from the process stream by reaction according, for example, to the following mechanisms:

$$2KOH+H_2S \rightarrow K_2S+2H_2O \quad (1);$$

and $$K_2O+H_2S \rightarrow K_2S+H_2O \quad (2).$$

The equilibrium is particularly good for potassium such that $H_2S$ may be quantitatively removed from a process stream of hydrocarbon and $H_2$, especially at a temperature of 250° to 500° C.

The most favorable equilibrium is obtained if water in the system is maintained at low levels (e.g., <20 ppm). This can be accomplished, for example, by using feed and recycle driers to minimize introduction of water into the system.

Although sulfur sorbents made by impregnation of alumina with potassium nitrate work very well for sulfur removal, even after calcining at 480°-510° C., such sorbents will typically contain about 2.0 weight percent nitrogen. The nitrogen is then presumably reduced by reaction with $H_2$ during the plant startup to generate ammonia and $H_2O$. Ammonia and $H_2O$ have been found to be harmful to zeolite type catalysts during operation For example it is generally believed that high levels of water accelerate catalyst fouling.

Therefore, this aspect of the invention involves a potassium sulfur sorbent made by impregnating, preferably alumina, with a solution containing a potassium compound, which does not contain nitrate or other nitrogen containing compounds, preferably potassium carbonate. Nitrogen-free potassium compounds such as potassium carbonate are sufficiently soluble in water (e.g., 10 to 105 gms/100 cc) to make sorbents by a simple impregnation method. The mount of the potassium compound used is calculated to make the sorbent with a desired potassium content on the calcined sorbent (e.g., 5–40 weight percent). When the sorbent is dried and calcined and carbonate decomposes according to the mechanism:

$$K_2CO_3 \rightarrow K_2O+CO_2 \text{ (300°-510° C.)}$$

Any small amount of carbonate remaining in the sorbent can be reduced with $H_2$ in the plant startup according to the mechanism:

$$K_2CO_3+H_2 \rightarrow 2KOH+CO \text{ (300°-425° C.)}$$

without evolving water. While carbon monoxide also could be harmful to a platinum containing catalyst, e.g., a Zeolite-type catalyst, carbon monoxide gas can be easily swept out of the system using normal purging procedures, possibly before loading the platinum zeolite catalyst.

Although potassium carbonate is preferred, other non-nitrogen containing potassium compounds are likely candidates for making the nitrogen-free potassium containing sorbent. In selecting such a compound the pertinent considerations should be its availability, solubility in water, temperature of decomposition during calcination, generation of no harmful residue during startup or operation and reasonable cost. Other suitable potassium compounds include potassium chloride, bromide, acetate formate, bicarbonate, oxalate, phosphate, etc. Of course, potassium compounds which contain sulfur should not be used because of the necessity to exclude sulfur compounds from the overall reactor system. This would make compounds such as potassium sulfate, sulfite, etc. unacceptable.

The resulting feedstream therefore has a sulfur concentration which has heretofore been unrealized in the reforming industry, e.g., as low as 1 ppb sulfur. The combination of the two solid sulfur sorbents and intermediate conversion catalyst permit one to obtain such low levels in an efficient and effective manner. More importantly, the subject system and process when integrated into a reforming process can permit one to run the overall reforming process continuously for a period of up to 2 years while safely maintaining the sulfur concentration in the feed at levels of 10 ppb or less, and most preferably about 1 ppb, over such a lengthy period of time. The continuous operation for a period of up to two years is only possible due to the aforedescribed sulfur removal system and its ability to remove sulfur to levels as low as 1 ppb sulfur. Without such a low level of sulfur concentration in the feedstream, the stability of the highly sulfur sensitive reforming catalyst used in the reforming operation could not be realized.

In another embodiment of the present invention, analyzers 8 and 9 can be used to monitor the sulfur level of the hydrocarbon stream entering and exiting the sulfur sorber 7. Such monitoring will permit one to evaluate the effectiveness of the sulfur sorber and make adjustments accordingly, e.g., in reaction conditions or in replacing the sulfur sorbent. It is important to replace both sulfur sorbents when the sorbed sulfur level reaches a predetermined level. Replacement of the sulfur sorbent is much easier to accomplish than replacing or regenerating poisoned zeolitic reforming catalyst.

When using such analyzers, however, the analyzers must be sufficiently sensitive to permit detection of such low amounts of sulfur as 10 ppb or less in a hydrocarbon stream. Commercially available analyzers can be appropriately modified. For example, a commercially available JEROME $H_2S$ sulfur analyzer can be modified to perform the desired task.

Accordingly, once the hydrotreated naphtha feedstock has been processed in accordance with the sulfur removal system of the present invention, it can then be passed on for reforming under conventional reforming conditions for the production of aromatics. The reforming catalyst used in the reforming operation for the production of aromatics is preferably a large-pore zeolite charged with one or more dehydrogenating constituents, e.g., a Group VIII metal such as platinum. The term "large-pore zeolite" is defined as a zeolite having an effective pore diameter of 6 to 15 Angstroms.

Among the large-pore crystalline zeolites which have been found to be useful in the practice of the present invention, type L zeolite, zeolite X, zeolite Y and faujasite have been found to be the most effective and have apparent pore sizes on the order of 7 to 9 Angstroms.

The composition of type L zeolite, expressed in terms of mole ratios of oxides, may be presented by the following formula:

$$(0.9\text{–}1.3)M_{2/n}O:Al_2O_3(5.2\text{–}6.9)SiO_2:yH_2O$$

In the above formula M represents a cation, n represents the valence of M, and y may be any value from 0 to about 9. Zeolite L, its X-ray diffraction pattern, its properties, and method for its preparation are described in detail in, for example, U.S. Pat. No. 3,216,789, the contents of which is hereby incorporated by reference. The actual formula may vary without changing the crystalline structure for example, the mole ratio of silicon to aluminum (Si/Al) may vary from 1.0 to 3.5.

The chemical formula for zeolite Y expressed in terms of mole ratios of oxides may be written as:

$$(0.7\text{–}1.1)Na_2O:Al_2O_3:xSiO_2:yH_2O$$

In the above formula, x is a value greater than 3 and up to about 6. Y may be a value up to about 9. Zeolite Y has a characteristic X-ray powder diffraction pattern which may be employed with the above formula for identification. Zeolite Y is described in more detail in U.S. Pat. No. 3,130,007. U.S. Pat. No. 3,130.007, the contents of which is hereby incorporated by reference.

Zeolite X is a synthetic crystalline zeolitic molecular sieve which may be represented by the formula:

$$(0.7\text{–}1.1)M_{2/n}O:Al_2O_3:(2.0\text{–}3.0)SiO_2:yH_2$$

In the above formula, M represents a metal, particularly alkali and alkaline earth metals, n is the valence of M, and Y may have any value up to about 8 depending on the identity of M and the degree of hydration of the crystalline zeolite. Zeolite X, its X-ray diffraction pattern, its properties, and method for its preparation are described in detail in U.S. Pat. No. 2,882,244, the contents of which is hereby incorporated by reference.

It is preferred that the more sulfur sensitive reforming catalyst used in this invention is a type L zeolite charged with one or more dehydrogenating constituents.

The conditions of the reforming operation are those generally employed in the reforming industry to produce aromatics from aliphatic hydrocarbons. The conditions can be varied to focus upon the production of a particular aromatic, e.g., benzene. The choice of catalyst and condition for such a focused production is well known to the art. For example, see U.S. Pat. No. Re. 33,323, the contents of which are herein incorporated by reference.

In another embodiment of the present invention, a protective sulfur sorbent can be employed before any or all reforming reactors as a further safeguard against sulfur poisoning. In newly constructed plants, the use of such "guard" sorbents may not be necessary. When utilizing older equipment, however, the use of such protective sulfur sorbents may be more advisable. The protective sulfur sorbent can be the same as that used in sorber 7, and is preferably comprised of potassium on alumina. It is also preferred that the material of the sorbent itself contain very little sulfur contaminants.

Generally, the protective sulfur sorbent is contacted at very high temperatures due to a preheating of the feedstreams to the reforming reactor. The temperature can range greatly, but is generally in the range of from about 450° to 650° C. The protective sulfur sorbent can exist as a separate physical structure, e.g., a "guard pot", upstream and apart from the reforming reaction, or can be placed in the same reaction vessel as the reforming catalyst, e.g., as a separate layer in the reaction vessel. If the sorbent is given the proper porosity and shape it can even be intermixed with the reforming catalyst in the same bed. As any residual organic sulfur is converted by the reforming catalyst to $H_2S$, the sorbent removes it, preventing harm to subsequent beds, and prolonging operational life of the system because the sorbent functions well at reforming temperatures.

The invention will be further illustrated in greater detail by the following specific example. It is understood that this example is given by way of illustration and is not meant to limit the disclosure of the claims to follow. All percentages in the example, and elsewhere in the specification, are by weight unless otherwise specified.

EXAMPLE 1

A naphtha hydrocarbon feed containing 200 ppm sulfur was hydrotreated in a conventional hydrotreater operating at high severity. The product was subsequently fractionated to produce a C6+ stream containing 2 ppm sulfur. The partially desulfurized stream was then hydrotreated and fractionated again to produce a hexane stream containing 50 ppb sulfur which was used as feed to a reforming process.

The hydrotreated feed was next contacted with a commercial nickel sulfur sorbent, UCI C28 sold by United Catalyst, Inc. The size of this first sulfur sorber was designed to achieve a >90% reduction in hydrotreated feed sulfur over a two year period assuming an average inlet sulfur level of 0.2 ppm. It was also designed to provide 90% sulfur removal for a few days in the event of severe upstream hydrotreater upsets where sulfur levels could reach 10 ppm.

The amount of sorbent relative to feed was such that the overall space rate through the sorber was 3.4 LHSV. Other sorber conditions included a pressure of about 180 psig and a temperature between 115°-177° C. (240°-350° F.). At these conditions the sulfur content of the feed out of the sorber was <20 ppb compared to 50 ppbw at the inlet of the sorber. The values were measured with a Tracor Atlas sulfur analyzer (model 825R-D/856) The 20 ppb value is the lower detection limit of the instrument.

The condition of the sorbent was monitored by periodically sampling the material and determining its sulfur content with a combustion/titration method. It is anticipated that the sorbent would be replaced when the sulfur level on the sorbent is between about 1% and about 16.7% by weight.

The liquid product from this first sulfur sorber was then contacted in reactor with 0.2 wt. % platinum on alumina in the presence of hydrogen to convert organic sulfur, including thiophenes, to $H_2S$. The reactor was operated at a temperature of 260°-345° C. (500°-650° F.), a hydrogen to hydrocarbon mole ratio of from 3-6, a pressure of 125 psig, and an LHSV =3.

The effluent from this reactor was then fed to a second sulfur sorber, containing a high temperature sorbent comprised of 8-10 wt. % potassium on alumina (K/Al). The operating conditions for the sorber are similar to those employed in the foregoing reactor. This high temperature sorbent has a sulfur loading capacity of about 1 wt %. However, it is anticipated to operate only until the sulfur level reaches about 1,000-3,000 ppm. The gaseous feeds coming into and out of the potassium on alumina sulfur were are measured with a modified Jerome $H_2S$ sulfur analyzer. The samples were taken online by cooling a slip stream from the reactors.

The analyzer was modified to sample hydrocarbon streams by adding a value before its "zero" air filter to bypass the filter during sampling. This prevented condensation of the hydrocarbon in the filter which would otherwise render the analyzer inoperative. Another measure to ensure that condensation did not occur was to dilute the hydrocarbon stream 1:1 with $N_2$ before sampling.

The desulfurized effluent from the second sulfur sorber had less than 5 ppb sulfur. It was fed in series to four aromatics production reactors. Each reactor had a furnace to heat the feed to 850°-1150° F. prior to entering the reactor and a bed of potassium on alumina (K/Al) sulfur sorbent at the reactor inlet in separate "guard pots". The reactors contained a barium L-zeolite catalyst containing 0.6 wt. % platinum. The hydrocarbon product from the reactors was mainly benzene and unreacted hexanes. The reaction also produced $H_2$ and light gases.

The support material separating the K/Al bed and the L-zeolite bed was chosen so that the material was <10 ppm sulfur. The preferred support used was Alcoa tabular alumina containing only 8 ppm sulfur.

The sulfur level on the catalysts in the four reactors were analyzed over several months of operations, which included coke-removing catalysts regeneration.

After 19 months on-stream the sulfur levels for the Pt-L-zeolite catalysts in the four reactors were measured, with results as shown in Table 1.

TABLE 1

| Catalyst Description | Sulfur, ppm |
|---|---|
| Reactor 1 TOP | 10.0 |
| Reactor 1 BTM | 13.0 |
| Reactor 2 TOP | 12.0 |
| Reactor 3 BTM | 14.0 |
| Reactor 4 TOP | 9.0 |
| Reactor 4 BTM | 16.0 |

This examples demonstrates the effectiveness of the sulfur protection system. Based on the foregoing catalyst analysis the system has desulfurized the Aromax feedstream to <1 ppb over this time period.

While the invention has been described with preferred embodiments, it is to be understood that variations and modifications may be resorted to as will be apparent to one skilled in the art. Such variations and modifications are to be considered within the purview and the scope of the claims appended hereto.

What is claimed:

1. A method for removing sulfur from a hydrotreated naphtha feedstock containing sulfur compounds, comprising contacting the naphtha feedstock with a first solid sulfur sorbent comprising a sulfur scavenging metal on a support to thereby form a first effluent;

contacting the first effluent with a sulfur conversion catalyst comprising a Group VIII metal in the presence of hydrogen under conditions sufficient to convert organic sulfur to hydrogen sulfide and thereby form a second effluent; and contacting the second effluent with a second solid sulfur sorbent containing a Group IA or Group IIA metal to thereby lower the sulfur content of the feedstock to less than 10 ppb.

2. The method of claim 1, wherein the first solid sulfur sorbent is comprised of nickel on a support comprising an inorganic oxide.

3. The method of claim 1, wherein the first solid sulfur sorbent is comprised of about 55 weight percent nickel on an amorphous silica bound with alumina.

4. The method of claim 1, wherein the sulfur conversion catalyst with which the first effluent is contacted comprises platinum as the Group VIII metal.

5. The method of claim 4, wherein the sulfur conversion catalyst comprises platinum on alumina.

6. The method of claim 1, wherein the second solid sulfur sorbent contains potassium.

7. The method of claim 6, wherein the second solid sulfur sorbent is prepared by impregnating a support with a non-nitrogen containing potassium compound.

8. The method of claim 7, wherein potassium carbonate is used to impregnate the support.

9. The method of claim 6, wherein the second sulfur sorbent comprises potassium on alumina.

10. The method of claim 7, wherein the support impregnated with the non-nitrogen containing potassium compound is alumina containing.

11. The method of claim 1, wherein the feedstock containing less than 10 ppb sulfur obtained after contact with the second solid sulfur sorbent is then contacted with another solid sulfur sorbent comprising potassium on alumina, with the contacting occurring at a temperature greater than the temperature used in the contacting step with the second solid sulfur sorbent.

12. The method of claim 1, wherein the first solid sulfur sorbent with which the naphtha feedstock is contacted comprises nickel on an inorganic oxide support; the sulfur conversion catalyst with which the first effluent is contacted comprises platinum on alumina; and the second solid sulfur sorbent with which the second effluent is contacted comprises potassium on alumina.

13. The method of claim 12 wherein the first solid sulfur sorbent is comprised of about 55 weight percent nickel on an amorphous silica bound with alumina.

14. The method of claim 12, wherein the second solid sulfur sorbent is prepared by impregnating the alumina with a non-nitrogen containing potassium compound.

15. The method of claim 1, wherein the sulfur content of the feedstock is lowered to about 1 ppb or less.

16. The method of claim 12, wherein the sulfur content of the feedstock is lowered to about 1 ppb or less.

17. The method of claim 1, wherein the sulfur content of the feedstock is analyzed both before and after each of the contacting steps.

18. The method of claim 1, wherein the contacting with the first solid sulfur sorbent is conducted under conditions of about 0.2 to 20 LHSV; from about 100° to about 200° C. and a pressure of less than 200 psig;

the contacting with the sulfur conversion catalyst is conducted under conditions of about 1-20 LHSV; a mole ratio of hydrogen to hydrocarbon ranging from 1:1 to 10:1; a temperature of from about 250° C. to about 450° C. and a pressure of from about 15 to about 500 psig; and, the contacting with the second solid sulfur sorbent is conducted under conditions of about 1-20 LHSV; a pressure of from about 15 to about 500 psig and a temperature in the range of from about 250° C. to 450° C.

19. The method of claim 12, wherein the contacting with the first solid sulfur sorbent is conducted under conditions of about 1 to 5 LHSV; a pressure ranging from about 100 to 200 psig; and a temperature in the range of about 115° to 175° C.;

the contacting with the sulfur conversion catalyst is conducted under conditions of about 2 to 10 LHSV; a mole ratio of hydrogen to hydrocarbon ranging from 2:1 to 6:1; a temperature of from about 250° C. to about 425° C. and a pressure of from about 50 to 300 psig; and, the contacting with the second solid sulfur sorbent is conducted under conditions of about 2 to 10 LHSV; a pressure of from about 50 to 300 psig and a temperature in the range of about 250° C. to about 425° C.

20. A method of reforming a naphtha feed which comprises hydrotreating the naphtha feed with a first solid sulfur sorbent comprising a metal on a support, thereby forming a first effluent;

contacting the first effluent with a sulfur conversion catalyst comprising a Group VIII metal in the presence of hydrogen under conditions sufficient to convert organic sulfur to hydrogen sulfide, thereby forming a second effluent; and contacting the second effluent with a second solid sulfur sorbent comprising a Group IA or IIA metal, to thereby lower the sulfur content of the feed to less than 5 ppb sulfur; and then forwarding the resulting feed to a reforming operation.

21. The method of claim 20, wherein the reforming operation is comprised of one or more reactors containing a reforming catalyst.

22. The method of claim 20, wherein the reforming operation is operated under conditions to enhance benzene production.

23. The method of claim 20, wherein the method further comprises recovering an aromatic containing product stream.

24. The method of claim 22, wherein the method further comprises recovering a product stream rich in benzene.

25. The method of claim 20, wherein prior to forwarding the feed to the reforming operation the feed is first contacted with a solid sulfur sorbent comprising potassium on alumina at a temperature greater than the temperature used for the contacting step with the second solid sulfur sorbent.

26. The method of claim 21, wherein prior to each reactor the feed is contacted with a solid sorbent comprising potassium on alumina at a temperature greater than the temperature used for the contacting step with the second solid sorbent.

27. The method of claim 25, wherein the contacting with the solid sulfur sorbent is conducted at a temperature of about 480° to about 570° C.

28. The method of claim 20, wherein the sulfur content of the feedstream is analyzed both before and after each contacting step.

29. The method of claim 20, wherein the first solid sulfur sorbent is comprised of nickel on a support comprising an inorganic oxide.

30. The method of claim 29, wherein the first solid sulfur sorbent is comprised of about 55 weight percent nickel on an amorphous silica bound with alumina.

31. The method of claim 20, wherein the conversion catalyst comprises platinum as the Group VIII metal.

32. The method of claim 20, wherein the conversion catalyst comprises platinum on alumina.

33. The method of claim 20, wherein the second solid sulfur sorbent comprises potassium.

34. The method of claim 33, wherein the second solid sulfur sorbent was prepared by impregnating a support with a non-nitrogen potassium compound.

35. The method of claim 34, wherein potassium carbonate was used to impregnate the support.

36. The method of claim 34, wherein the second solid sulfur sorbent comprises potassium on alumina.

37. The method of claim 35, wherein the impregnated support was alumina.

38. The method of claim 20, wherein the first solid sulfur sorber comprises nickel on an inorganic oxide support, the conversion catalyst comprises platinum on alumina, and the second solid sulfur sorbent comprises potassium on alumina.

39. The method of claim 38, wherein the first solid sulfur sorbent is comprised of about 55 weight percent nickel on an amorphous silica bound with alumina.

40. The method of claim 38, wherein the second sulfur sorbent was prepared by impregnating alumina with a non-nitrogen containing potassium compound.

41. The method of claim 20, wherein the reforming operation comprises passing the hydrocarbon feed in contact with a catalyst comprising a large pore zeolite containing at least one Group VIII metal to produce aromatics and hydrogen.

42. The method of claim 41, wherein the large pore zeolite is an L-zeolite.

43. The method of claim 42, wherein the Group VIII metal is platinum.

44. The method of claim 41, wherein the Group VIII metal is platinum.

45. The method of claim 1, wherein the feedstock containing less than 10 ppb sulfur obtained after contact with the second solid sulfur sorbent is then contacted with another solid sulfur sorbent containing a Group IA or IIA metal, with the contacting occurring at a temperature greater than the temperature used in the contacting step with the second solid sulfur sorbent.

46. A method for removing sulfur from a hydrocarbon feedstock, comprising contacting the hydrocarbon feedstock with a first solid sulfur sorbent comprising a sulfur scavenging metal on a support to thereby form a first effluent;

contacting the first effluent with a sulfur conversion catalyst comprising a Group IIIV metal in the presence of hydrogen under conditions sufficient to convert organic sulfur to hydrogen sulfide and thereby form a second effluent; and contacting the second effluent with a second solid sulfur sorbent containing a Group IA or IIA metal.

* * * * *